United States Patent [19]

Johansson et al.

[11] 4,414,764

[45] Nov. 15, 1983

[54] WEAR PARTS SYSTEM

[75] Inventors: Arne Johansson; Torsten Larsson, both of Karlskoga; Ove Nilsson, Örebro, all of Sweden

[73] Assignee: Aktiebolaget Bofors, Bofors, Sweden

[21] Appl. No.: 360,867

[22] Filed: Mar. 22, 1982

[30] Foreign Application Priority Data

Mar. 26, 1981 [SE] Sweden ..... 8101935

[51] Int. Cl.[3] ..... E02F 9/28

[52] U.S. Cl. ..... 37/141 T; 37/142 A

[58] Field of Search ..... 37/141 T, 141 R, 142 R, 37/142 A

[56] References Cited

U.S. PATENT DOCUMENTS

| | | | |
|---|---|---|---|
| 2,919,506 | 1/1960 | Larsen | 37/142 A |
| 3,126,654 | 3/1964 | Eyolfson et al. | 37/142 A |
| 3,572,785 | 3/1971 | Larson | 37/142 A X |
| 4,182,058 | 1/1980 | Poncin | 37/142 A |
| 4,233,761 | 11/1980 | Ryerson | 37/142 R |
| 4,267,653 | 5/1981 | Hahn et al. | 37/142 A |
| 4,271,615 | 6/1981 | Jones | 37/142 A |

*Primary Examiner*—Edgar S. Burr
*Assistant Examiner*—Moshe I. Cohen
*Attorney, Agent, or Firm*—Pollock, Vande Sande & Priddy

[57] ABSTRACT

This invention relates to a wear-parts system of teeth for earth-moving machine shovels, mounted at the front of the shovel and comprising several loosely interconnected parts such as tooth points (1), adapters or holders (2, 9), cutting edge protectors (11) etc. The interconnection of these parts is carried out by means of interacting male and female formed parts (15, 16, 19, 20 and 13, 14, 21, 22). The parts are locked in the assembled position by means of specially formed locking wedges (7) fitted at right angles to the assembly direction. Openings are provided in the various parts for the locking devices.

4 Claims, 14 Drawing Figures

43
23
7
24
35
36
e 3
6
5
8
22
4
16
7
20
2
19
1
11
15
9
10
21

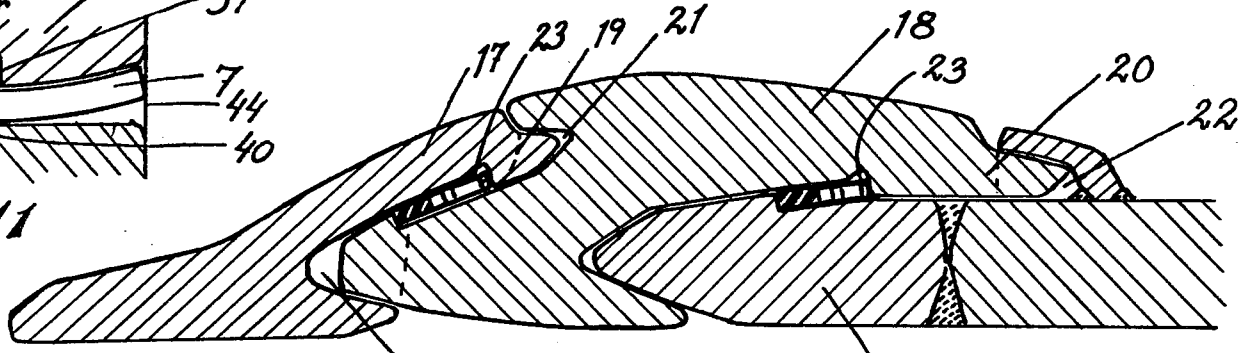
Fig. 10
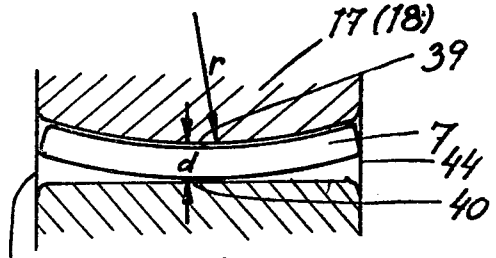
Fig. 11
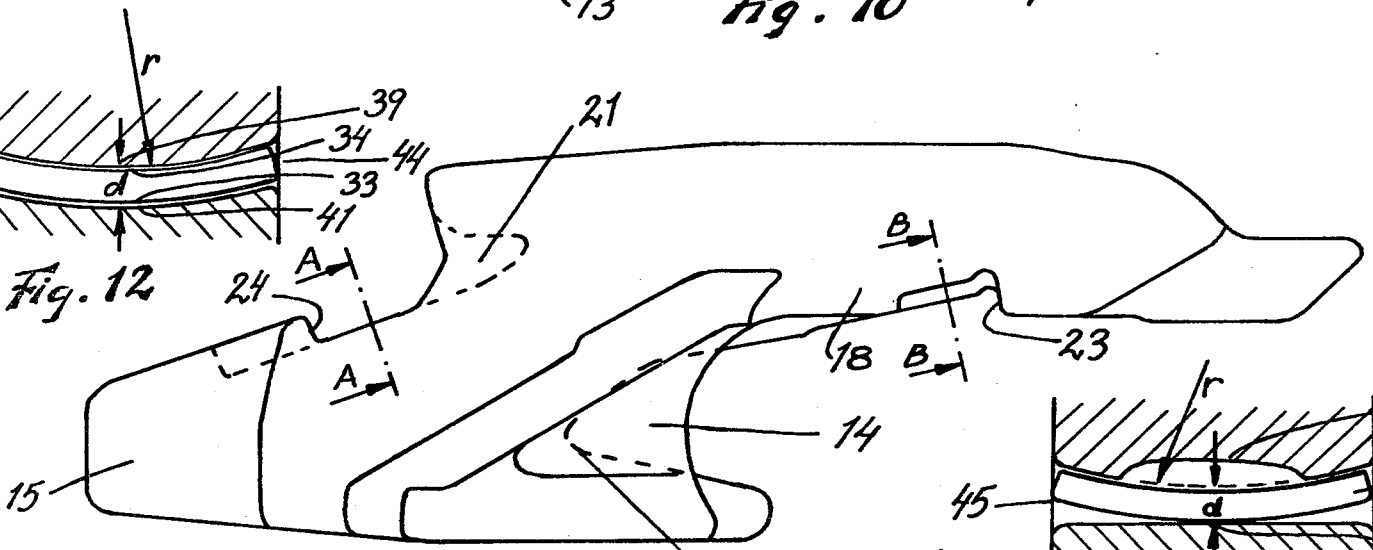
Fig. 9
Fig. 12
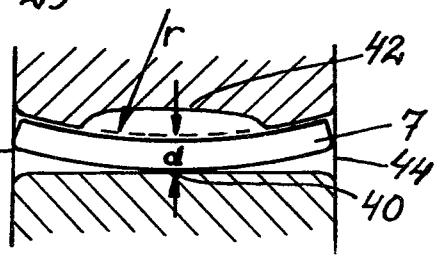
Fig. 13

WEAR PARTS SYSTEM

The present invention relates to a system for holding cutting tool teeth used on earth moving machines such as mechanical loaders, excavating machines, and mechanical shovels. Similar systems of teeth are often referred to as wear parts. In these systems the foremost parts such as teeth tips, and to a certain extent even the shovel front cutting edges are subjected to very extensive wear. It is therefore advantageous if these parts are relatively easily replaceable. With smaller cutting tools, normally the complete set of teeth is replaced, whilst in very large cutting tools the teeth are divided up into several parts which can be replaced individually.

The system of teeth according to the invention includes a tooth tip, an adapter, an inward folded distance piece welded to the shovel front, and a locking wedge which when placed locks the various parts relative to each other. The interconnection of the various parts is carried out by interacting complementary specially formed male and female parts.

The invention includes a specially formed locking wedge. The various parts are provided with locking grooves adapted to this type of locking wedge.

The invention as defined by the patent claims is described with reference to the enclosed figures of a preferred embodiment which show a complete system of teeth and all its parts.

DESCRIPTION OF THE FIGURES

FIGS. 2–9 shows on a larger scale the parts in the system, where:

FIG. 2 shows a tooth tip.

FIG. 3 shows a normal tooth adapter.

FIG. 4 shows a shovel corner adapter.

FIG. 5 shows a normal distance piece.

FIG. 6 shows a corner distance piece.

FIG. 7 shows a locking wedge with locking device.

FIG. 8 shows a cutting edge protector.

FIG. 9 shows a tooth adapter, and

FIG. 10 shows in lateral cross-section an assembled system of teeth.

FIGS. 11 and 12 show a detailed cross-section along the length of the locking wedge with several variations of the locking grooves into which the locking wedges fit.

FIG. 13 shows an alternative embodiment of the locking groove which avoid transmission of locking forces on the wedge 7.

DESCRIPTION OF THE PREFERRED EMBODIMENT

Figures 1, 14:
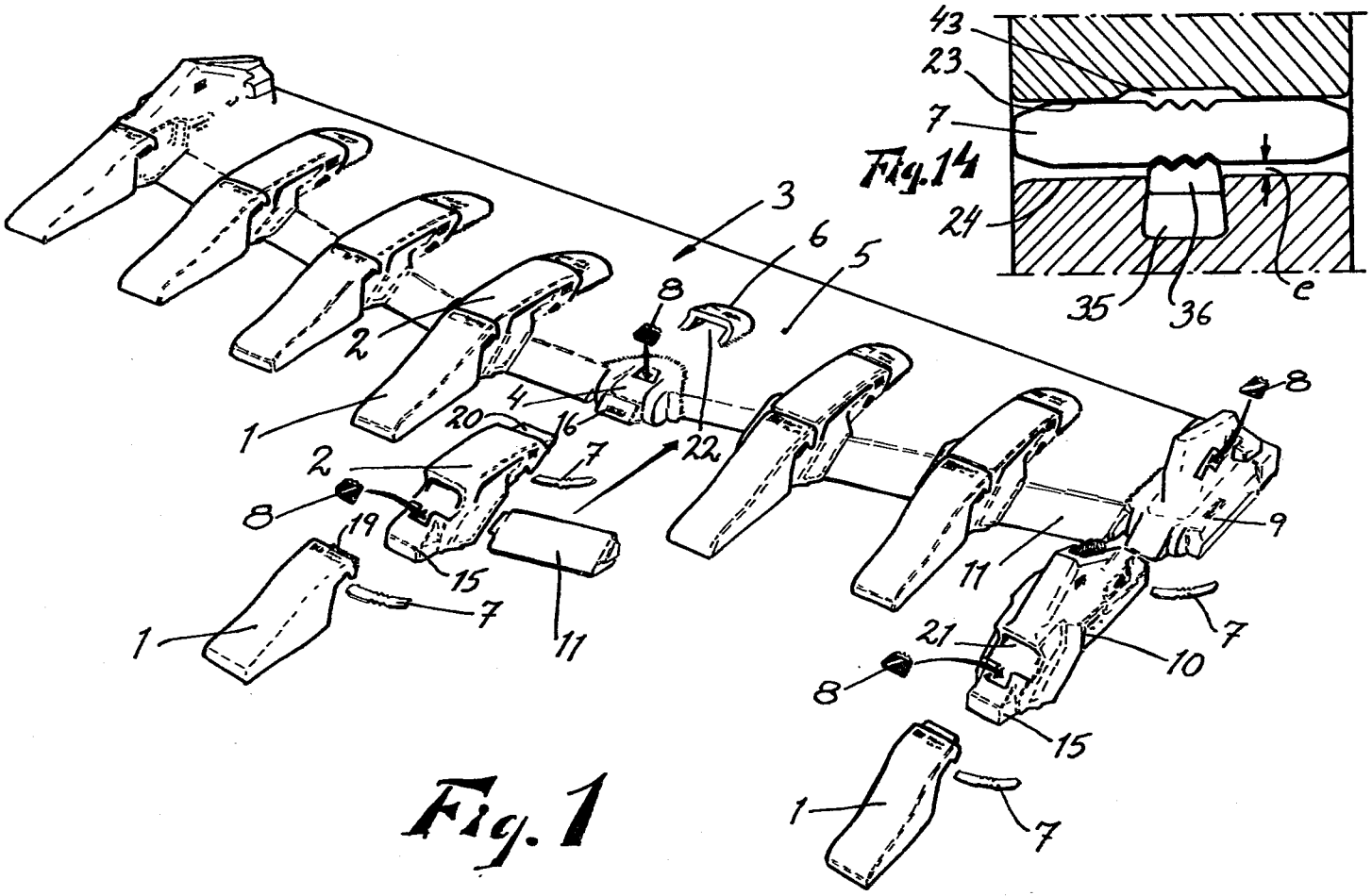
FIG. 1 shows in angled projection a cutting edge for a mechanical loader shovel equipped with the system of teeth as described by the invention.
FIG. 14 shows the locking device engaging a respective locking wedge.
Figure 2:
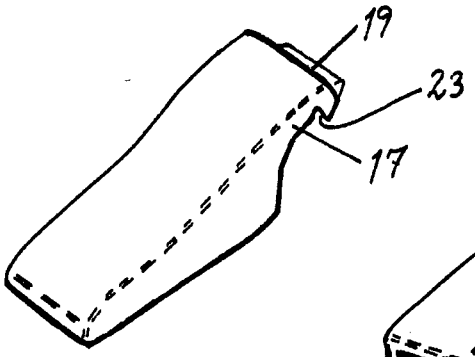
Figure 3:
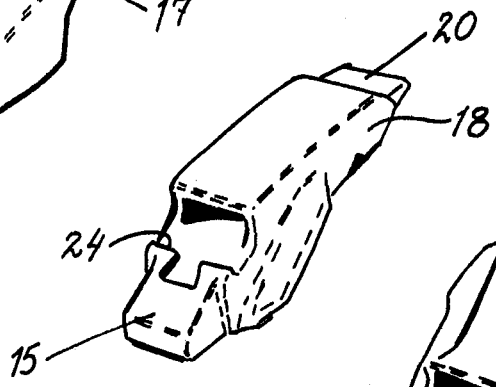

According to the preferred embodiment of the invention the system of teeth normally includes a tooth tip (1), an adapter (2), an inward folded distance piece (4) welded to the shovel front (3), a cover (6) welded to the upper side (5) of the shovel front, and a locking wedge (7) with associated locking device (8). When a particular tooth is to be fit to a shovel, special corner distance pieces (9) which are folded inwards and welded to the corner of the shovel are used together with suited corner adapters (10). Between the various teeth can be fitted loose replaceable cutting edges (11). These are kept in place by suitable grooves (12) in the adjacent adapters (see FIG. 9).

The joints between tooth and adapter, and between adapter and the inward folded distance piece in the shovel front, include the same basic functions. Both tooth tip (1) and adapter (2) or (10), grip by means of a recess or female part (13) or (14), over a projection from the parts (2 or 10, alternatively 4 or 9), immediately behind, male part (15) or (16), and extend via a rear overhang (17), or (18), along the rearwardly located part, which can be either the adapter (2) or (10), or alternatively the inward folded distance piece (4) or (9) in the shovel front. The rear end of the overhang is provided with a rearward projecting male part (19) or (20). This male part functions together with a forward opening female part (21), or (22), located in the part behind it. The female part (22) can either be formed as an integral part of the distance piece or the corner fitted distance piece (9), or as a loose, welded cover (6) on the upper side (5) of the shovel front.

Figure 4:
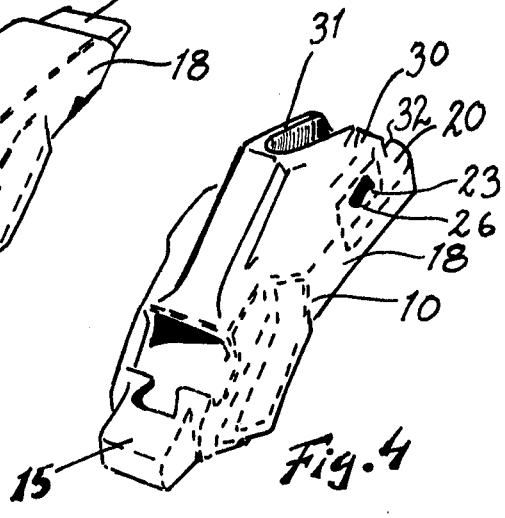
Figure 6:
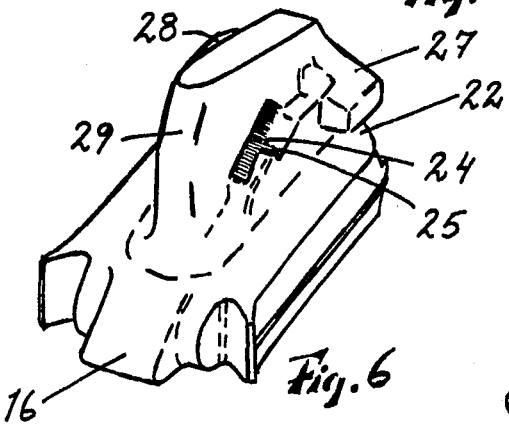
Figure 5:
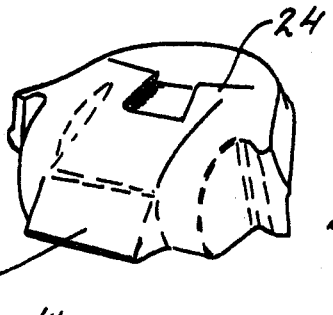
Figure 7:
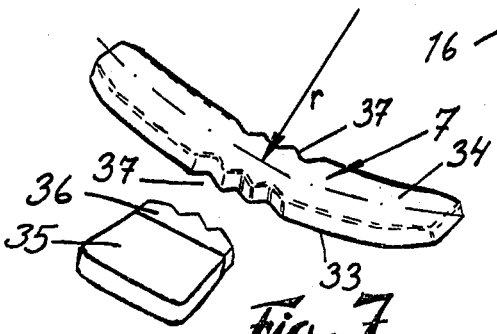
Figure 8:
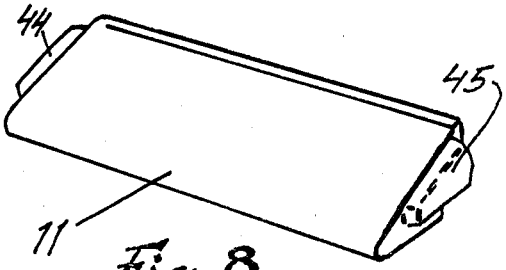

The jointly functioning male and female parts are meshed with each other when a part in front is pushed over a rear part. In order to lock the various parts relative to each other, a locking wedge is required which prevents a forward located part from being drawn out of a rear located part. This locking function is achieved in the system of teeth according to the invention, by a locking wedge which is pushed in between crosswise, and overhanging locking surfaces. The forward located part is provided with a forward facing locking surface (23), irrespective of whether it is a tooth (1), or an adapter (2) or (10), while the rear located part is provided with a rearward facing locking surface (24), irrespective of whether it is an adapter (2) or (10), or a distance piece (4) or (9). These locking surfaces can be formed as one edge of a right-angled groove in a tooth and the adapter overhangs (17) and (18) and the overhanging gripping parts of the distance pieces (4). Two such connected grooves form a tunnel for the rectangular cross-sectioned locking wedge. These grooves, as is shown in FIGS. 4 and 5, can be wholly, or partly, be a part of through-going openings (25) and (26), arranged in the distance pieces and adapters. This solution has therefore been chosen for the corner adapter (10) and the corner fitted distance piece (9). In the case of the latter, even the forward opening female part has been replaced by two lugs (27) and (28) which project to the side (lug (28) is hidden in the figure). These lugs are formed as a single unit with an upwards pointing ridge (29) intended to fit into and be welded to the side of the shovel. This ridge is provided with a lock opening (25). The corner adapter (10) has also two rearward projecting arms (30) and (31) so designed that when fitted they extend along both sides of the ridge (29). The outer ends of these arms each form a male part (32) which are designed to function with the lugs (27) and (28). In the arms (30) and (31) there are also the lock openings (26). The rear edge of the lock openings consequently replace the forward facing locking surface (23) which is normally located in the adapter.

In order to lock the various parts after they have been fitted a specially formed locking system is used. This locking system consists of a solid steel wedge (7) and a locking device (8). The locking device consists of an elastic compressible part (35) and a metal toothed catch (36). The wedge (7) is provided with grooves (37) which receive the teeth of the catch (36). A particular characteristic of the wedge is the fact that it has a rectangular cross-section and that it is bent in an arc along its length. Consequently the wedge has a convex broad side (33) and a concave broad side (34).

In order to use the wedge, the tunnel receiving the locking wedge and the associated locking surfaces, must be formed in such a way that at least the tunnel broad side which faces the same way as the concave side (34) of the wedge (7) has a profile which fits inside or is equal with the concave form of the wedge. In the same way, the relevant locking surfaces follow this form. In this connection reference should be made to FIGS. 11–13 which show a cross-section along the length of a locking wedge at A—A, alternatively B—B, with the adapters in place and equipped with a tooth tip.

The figures show that the form of the overhang must fit within the arc r which is equivalent to the radius of the concave broad side (34) of the locking wedge. Further, the distance d from the lowest point (39) of the locking wedge broad side, to the highest point (40) of the neighbouring parts broad side in equivalent to the space required for the wedge (7).

FIG. 11 shows a variation where the broad side of the overhand (39) describes an arc having a radius which is equal to the locking wedge broad side while the broad side of the opposing part is completely flat and only touches the longest point of the locking wedge. The locking surfaces provided in the locking wedge are raised so that they provide the side of the locking wedge with complete support. The foremost locking groove in the adapter, which is shown in the figures, is of this type.

FIG. 12 shows a variation where the opposing broad side (41) of the neighbouring part follows the convex broad side (33) of the locking wedge (7). This variation is illustrated in those figures which show the distance piece (4). This form can be specially suitable when the groove with locking surfaces (24) must begin and end with a level surface, as is the case with the distance piece (4).

FIG. 13 shows a variation where the overhang broad side facing the wedge is obviously not perfectly convex, but where its form (42) is within a convex profile whose radius is suited to the concave surface (34) of the locking wedge. With this design, the risk that a limited surface wear on the bearing surfaces of the jointly functioning male and female parts would transfer the bearing points for the reacting forces from the male and female surfaces to the wedge (7) is avoided. The wedge shall have a purely locking function and shall not transmitt the reacting forces between the parts.

One of the great advantages with the above described design is that the arc-shaped locking wedge is much easier to fit than flat wedges, especially when the relevant teeth are relatively close together. The risk that the locking wedge shall work itself out of its locked position is also practically eliminated. Even well locked, flat wedges can under certain circumstances work themselves loose from a theoretically well locked position. The bellied wedge is easily fitted in position by means of a few blows from a heavy hammer or similar.

Consequently the latter is entered at a downward angle to the front of the shovel, and not parallel with and immediately connected to the same, as is necessary in the case of horizontally fitted flat wedges.

The same advantage applies when the locking wedge in the equivalent way is disassembled with the aid of an arc formed drift.

The locking wedge (7) is further held in place by the locking device (8) (see FIG. 14). The locking device is fitted into a fishtail shaped groove connected to the rearward facing locking surface in the adapter, or alternatively the distance piece. When the locking wedge has been forced into position, its elastic part (35) is compressed, and under a certain amount of tension the teeth of the locking part (36) are forced into the toothed grooves (37) of the locking wedge (7). In order that the wedge (7) will have the best possible landing surface against the locking surface (23) of the overhang, it can be provided with a centrally located recess (43). A certain amount of play is necessary to get the wedge in position. Due to the tension in the elastic part (35), the play present in the assembled parts will be distributed between the locking surface (24) and the wedge (7). If the assembled parts are subjected to tensile forces, this play is eliminated and the solid locking wedge (7) is pressed between the locking surfaces (23) and (24).

The figures also illustrate a cutting edge protector (11) which is provided with two lugs (44) and (45) intended to lock in the locking groove (12), which is provided in the adapters between which the cutting edge protector is fitted. Consequently the said cutting edge protector is fitted at the same time as the adapters located on its both sides.

We claim:

1. A system for holding teeth to an earth moving machine shovel front comprising:
   - at least one tooth member having a rearwardly extending overhang, and a male projecting part rearwardly extending from said overhang;
   - an adapter having a forward opening female part receiving said male projecting part, said adapter also having a rearwardly extending overhang and male projecting part rearwardly extending from said overhang;
   - a cover member connected to said shovel front having an opening for receiving said adapter male projecting part;
   - a first tunnel through said adapter overhang and front shovel front part;
   - a second tunnel through said tooth overhang and said adapter;
   - said tunnels having surfaces forming locking surfaces, one of said surfaces comprising an edge of a right angled groove in a respective overhang, and the remaining surfaces comprising an opposite edge on a shovel front and tooth member;
   - first and second wedges inserted in said tunnels, said wedges being arcuate along a longitudinal direction and including teeth along opposite edges; and
   - first and second compressible locking devices having a toothed end extending through a groove in a respective locking surfaces for engaging teeth of said wedges, said locking devices maintaining said wedges in place.

2. A system of teeth in accordance with claim 1, wherein said locking devices consist of a toothed catch which faces the locking wedge with elastic rear parts which are compressible.

3. A system of teeth according to claim 1 wherein adapters to be fitted in the corners of the shovel are formed with two rearward extending arms which grip on each side of a ridge located on fitted distance pieces at said corners.

4. A system of teeth in accordance with claim 3 wherein said arms and ridge on the distance pieces are equipped with openings which function together with the adapter fitted in place and provide a lock opening to receive an arc-formed bent locking wedge.

* * * * *